US012410962B2

(12) United States Patent
Knatt

(10) Patent No.: US 12,410,962 B2
(45) Date of Patent: Sep. 9, 2025

(54) ICE MAKER WITH STAND PIPE DRAIN

(71) Applicant: True Manufacturing Co., Inc., O'Fallon, MO (US)

(72) Inventor: Kevin Knatt, St. Louis, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 206 days.

(21) Appl. No.: 18/061,194

(22) Filed: Dec. 2, 2022

(65) Prior Publication Data

US 2024/0183597 A1 Jun. 6, 2024

(51) Int. Cl.
*F25C 1/25* (2018.01)
*F04F 10/00* (2006.01)

(52) U.S. Cl.
CPC ..... *F25C 1/25* (2018.01); *F04F 10/00* (2013.01); *F25C 2400/14* (2013.01); *F25C 2500/06* (2013.01); *F25C 2600/04* (2013.01)

(58) Field of Classification Search
CPC .... F25C 1/25; F25C 2600/04; F25C 2500/06; F25C 2400/14; F04F 10/00
See application file for complete search history.

(56) References Cited

U.S. PATENT DOCUMENTS

| | | | | |
|---|---|---|---|---|
| 2,775,100 | A | 12/1956 | Howe | |
| 3,430,452 | A | 3/1969 | Dedricks et al. | |
| 5,718,847 | A * | 2/1998 | Koble, Jr. | G05D 9/12 137/142 |
| 7,082,782 | B2 | 8/2006 | Schlosser et al. | |

FOREIGN PATENT DOCUMENTS

| | | | |
|---|---|---|---|
| CN | 204574653 | U | 8/2015 |
| EP | 1795830 | A1 | 6/2007 |
| EP | 2226597 | A1 | 9/2010 |
| JP | S6319162 | U * | 2/1982 |
| JP | 62210366 | A | 9/1987 |
| JP | H09126577 | A * | 5/1997 |

OTHER PUBLICATIONS

Translated_JPS6319162 (Year: 1988).*
Translated_Tsutomu (Year: 1997).*
Extended European Search Report from EP Application No. 23213842.0, dated Jul. 10, 2024, 9 pages.

* cited by examiner

*Primary Examiner* — Jerry-Daryl Fletcher
*Assistant Examiner* — Samba Gaye
(74) *Attorney, Agent, or Firm* — Stinson LLP

(57) ABSTRACT

In an ice maker with a sump below an ice formation device and a pump for recirculating water from the sump to the ice formation device, water can drain through a stand pipe drain. A drain fitting is disposed in relation to a stand pipe such that the drain fitting's upper end is disposed above the top of the stand pipe, its lower end defines a water inlet adjacent the bottom of the sump, and its perimeter wall extends 360° about the stand pipe to define a drain passage extending from the water inlet to the top of the stand pipe. The upper end of the drain fitting defines a siphon release opening. The stand pipe drain can also include a valve for adjusting the drain between an overflow drain configuration and a siphon drain configuration.

20 Claims, 16 Drawing Sheets

ICE MAKER WITH STAND PIPE DRAIN

FIELD

This disclosure generally pertains to an ice maker with a stand pipe drain.

BACKGROUND

Certain dedicated ice maker appliances employ a water inlet that selectively imparts supply water into a sump so that water can be circulated from the sump to an ice formation device. It is known to provide a drain in the sump to prevent accidental overflow.

SUMMARY

In one aspect, an ice maker comprises an ice formation device. A sump is below the ice formation device. The sump has a bottom wall. A pump recirculates water from the sump to the ice formation device so that the water forms as ice on the ice formation device. A stand pipe extends upward from the bottom wall of the sump and has an open upper end portion. The stand pipe is configured so that water can flow into the stand pipe through the open upper end portion to drain from the sump. A drain fitting has a lower end portion, an upper end portion opposite the lower end portion, and a perimeter wall extending from the lower end portion to the upper end portion. The drain fitting is disposed in relation to the stand pipe such that the upper end portion of the drain fitting is disposed above the open upper end portion of the stand pipe, the lower end portion of the drain fitting defines a water inlet adjacent the bottom wall of the sump, and the perimeter wall extends 360° about the stand pipe such that the stand pipe and the drain fitting define a drain passage extending from the water inlet to the open upper end portion of the stand pipe. The upper end portion of the drain fitting defines a siphon release opening configured to provide fluid communication between the drain passage and an area outside the drain fitting.

In another aspect, a method of using an ice maker comprises using a stand pipe in a sump of the ice maker as an overflow drain. The ice maker is adjusted to use the stand pipe as siphon drain.

In another aspect, an ice maker comprises an ice formation device. A sump is below the ice formation device. A stand pipe drain is in the sump. The stand pipe drain is selectively adjustable between an overflow drain configuration in which the stand pipe drain is configured to drain water from the sump to an overflow water level and a siphon drain configuration in which the stand pipe drain is configured to drain water from the sump to a water level less than the overflow water level.

Other aspects will be in part apparent and in part pointed out hereinafter.

BRIEF DESCRIPTION OF THE DRAWINGS

Corresponding parts are given corresponding reference characters throughout the drawings.

DETAILED DESCRIPTION

Figure 1:
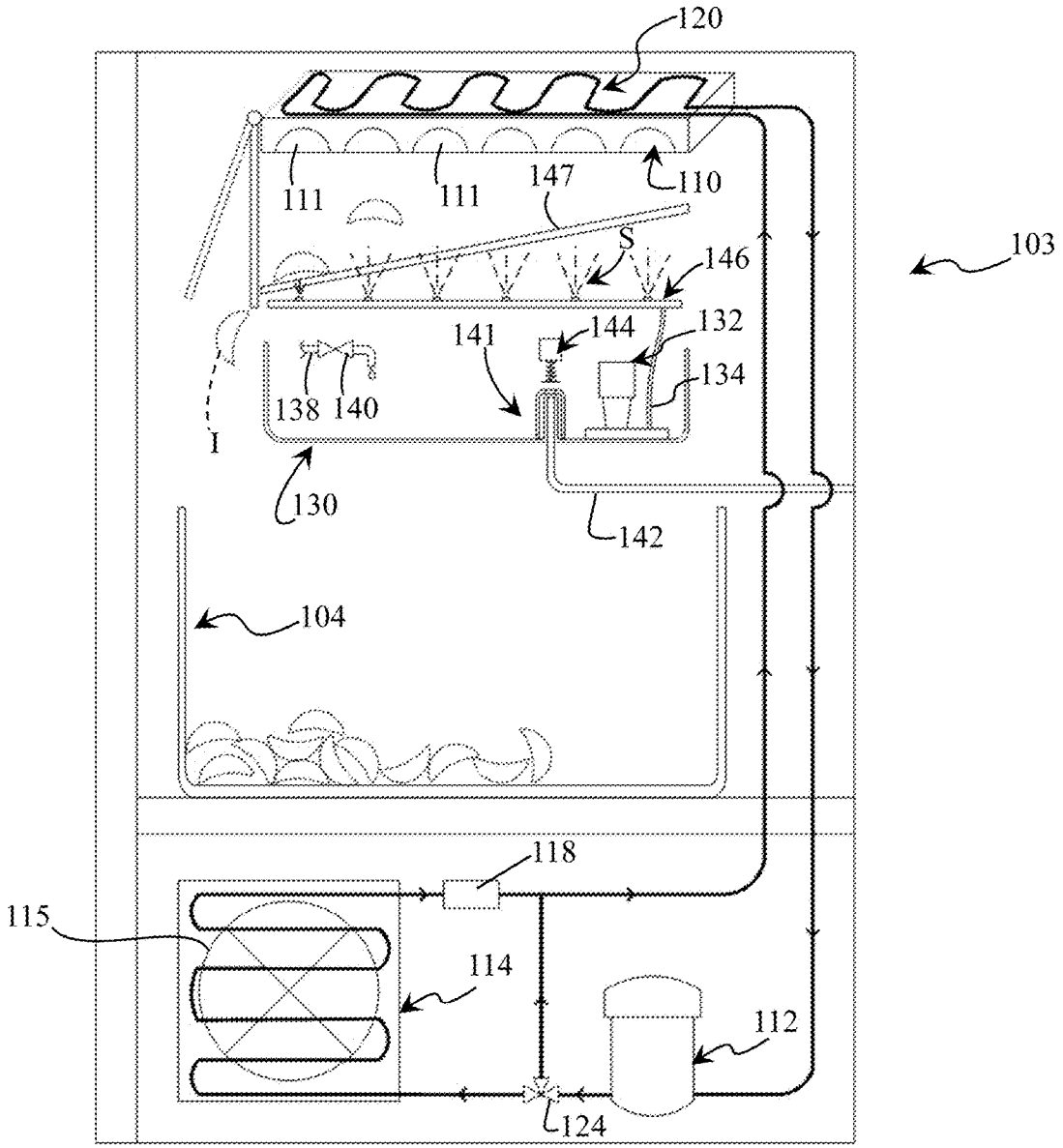
FIG. 1 is a schematic illustration of an ice maker in the scope of this disclosure.

Referring to FIG. 1, an exemplary embodiment of an ice maker in the scope of this disclosure is shown schematically at reference number 103. In one aspect, this disclosure pertains to a drain system for the ice maker 103. As will be explained in further detail below, the drain system of the illustrated ice maker can be configured to draw out impurities from the water so that relatively pure water is used to make ice. The illustrated drain system can also be selectively adjustable to operate as either an overflow drain or a siphon drain.

An ice maker in the scope of this disclosure may broadly comprise an ice formation device in which water can form into ice, a water system for directing water onto the ice formation device, and a refrigeration system configured to cool the ice formation device to a temperature at which at least some of the liquid water present in the ice formation device will freeze into ice. In the illustrated embodiment, the ice maker 103 is a vertical spray ice maker of the type which has a horizontally oriented freeze plate 110 that constitutes the ice formation device. The horizontal freeze plate 110 defines a plurality of ice molds 111 that open downward to receive water S sprayed upward from below. Those skilled in the art will recognize that this type of ice maker is used to make very hard, clear ice. Other types of ice makers such as batch ice makers with vertically oriented freeze plates are also contemplated to be in the scope of this disclosure. Batch ice makers with vertically oriented freeze plates differ from the illustrated ice maker in that the freeze plate extends in a generally vertical plane, with a water distributor above the vertical freeze plate so that water flows down the freeze plate during ice making cycles.

The refrigeration system of the ice maker 103 includes a compressor 112, a heat rejecting heat exchanger 114, a refrigerant expansion device 118 for lowering the temperature and pressure of the refrigerant, an evaporator 120 along the top side of the freeze plate 110, and a hot gas valve 124. The compressor 112 can be a fixed speed compressor or a variable speed compressor to provide a broader range of control possibilities. The compressor 112 cycles a form of refrigerant through the condenser 114, expansion device 118, evaporator 120, and the hot gas valve 124, via refrigerant lines.

As shown, the heat rejecting heat exchanger 114 may comprise a condenser for condensing compressed refrigerant vapor discharged from the compressor 112. In other embodiments, e.g., in refrigeration systems that utilize carbon dioxide refrigerants where the heat of rejection is trans-critical, the heat rejecting heat exchanger is able to reject heat from the refrigerant without condensing the refrigerant. In certain embodiments that utilize a gaseous cooling medium (e.g., air) to provide condenser cooling, a condenser fan 115 may be positioned to blow the gaseous cooling medium across the condenser 114. The condenser fan 115 can be a fixed speed fan or a variable speed fan to provide a broader range of control possibilities.

Hot gas valve 124 is configured to be selectively opened and closed to control freezing and harvesting of ice with the refrigeration system. During freezing, the hot gas valve 124 is closed to direct warm refrigerant vapor to the condenser 114. During ice harvest, the hot gas valve 124 is configured to open to direct warm refrigerant from the compressor 114 directly to the evaporator 120 to demold and harvest ice cubes from the freeze plate 110.

The refrigerant expansion device 118 can be of any suitable type, including a capillary tube, a thermostatic expansion valve, or an electronic expansion valve. In certain embodiments, where the refrigerant expansion device 118 is a thermostatic expansion valve or an electronic expansion valve, the ice maker 103 may also include a temperature sensor (not shown) placed at the outlet of the evaporator 120 to control the refrigerant expansion device 118. In other embodiments, where the refrigerant expansion device 118 is an electronic expansion valve, the ice maker 110 may also include a pressure sensor (not shown) placed at the outlet of the evaporator 120 to control the refrigerant expansion device 118 as is known in the art.

Figure 2:
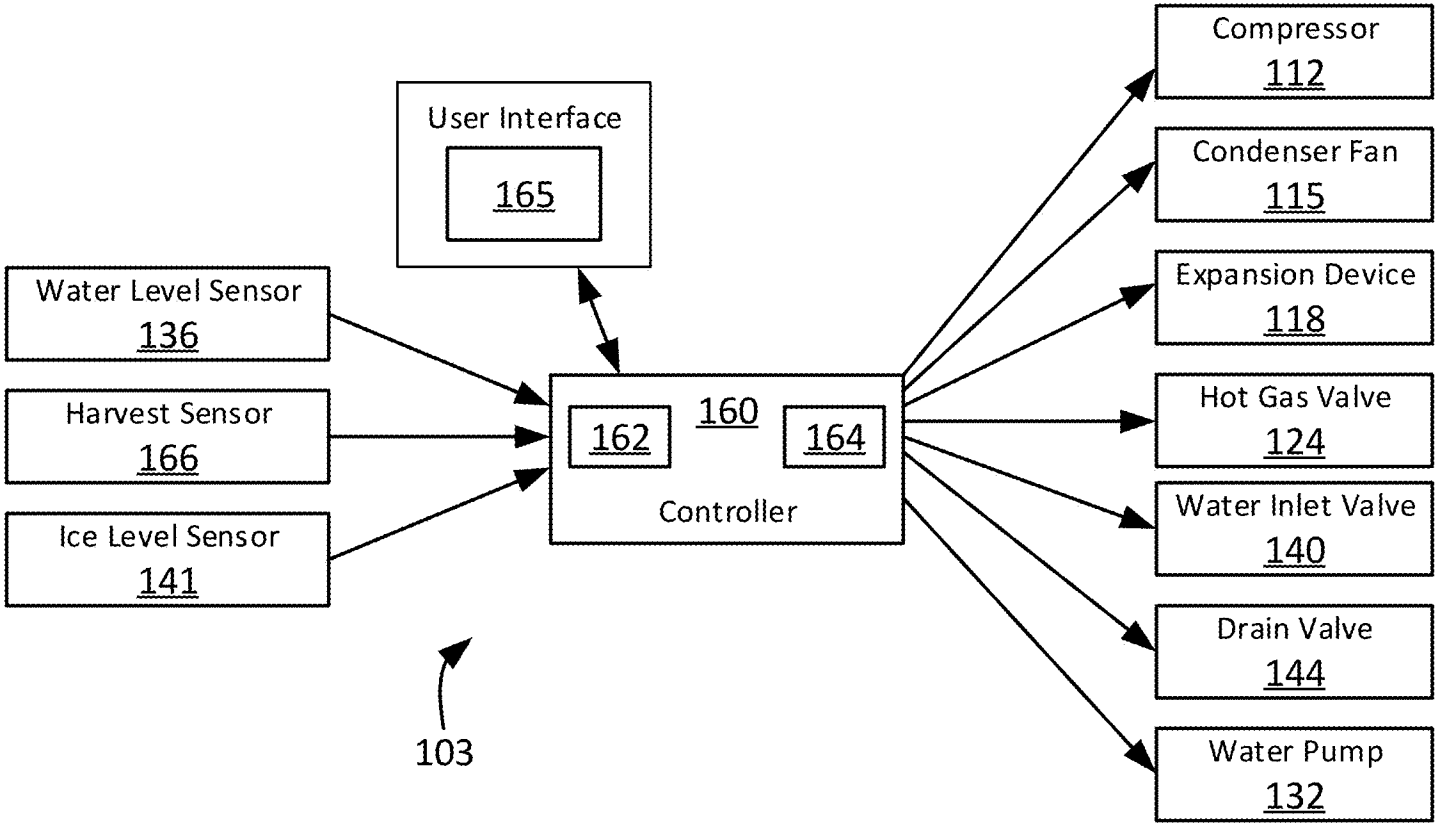
FIG. 2 is a schematic block diagram of a control system of the ice maker.

Referring still to FIG. 1, a water system of the illustrated ice maker 103 includes a sump 130, a water pump 132, a water line 134 (broadly, passaging), and a water level sensor 136 (shown schematically in FIG. 2). Water level sensor 136 can be any suitable type of water level sensor for signaling when water level in the sump reaches certain control thresholds. Examples of water level sensors commonly used in ice makers of this type include float sensors and pneumatic sensors. The water pump 132 could be a fixed speed pump or a variable speed pump to provide a broader range of control possibilities.

The water system of the ice maker 103 further includes a water supply line 138 and a water inlet valve 140 for filling the sump 130 with water from a water source (e.g., a municipal water utility). The illustrated water system further includes a stand pipe drain, generally indicated at reference number 141. The stand pipe drain 141 is connected to a drain line 142 for draining water from the sump 130. As will be explained in further detail below, the stand pipe drain 141 includes a drain valve 144 for selectively controlling drainage through the stand pipe drain.

The sump 130 is positioned below the freeze plate 110 to catch water falling from the freeze plate. The water line 134 fluidly connects the water pump 132 to a sprayer 146 below the freeze plate 110. The sprayer 146 is configured to spray liquid water S upward to the freeze plate 110. A slanted ice chute 147 is located between the sprayer 146 and the downward facing freeze plate 110. The ice chute 147 comprises a grill or other porous structure that allows spray S and falling liquid water to pass through the chute. But the ice chute 147 is configured to block pieces of frozen ice I from falling through the chute. Instead, harvested ice pieces I land on the chute 147 and slide forward, falling off of the bottom of the chute into the ice bin 104 below.

During an ice batch production cycle, the pump 132 is configured to pump water through the water line 134 and through the sprayer 146. The liquid S is sprayed upward past the chute 147 into the molds 111 of the freeze plate 110. Some of the water freezes in the molds 111 and unfrozen liquid water falls off of the freeze plate 110, past the chute 147 and the sprayer 146, into the sump 130 where it can be recirculated by the water pump 132. This water cycle continues to progressively chill the liquid water that is recirculating until a sufficient amount of the water freezes as ice in the molds 111. At that point the refrigeration, system opens the hot gas valve 124 to heat the freeze plate 110, melting the ice I until it demolds, falls onto the chute 147, and slides off the chute into the ice bin 104.

Referring to FIG. 2, the ice maker 103 includes a controller 160. The controller 160 includes at least one processor 162 for controlling the operation of the ice maker 103, e.g., for controlling at least one of the refrigeration system and the water system. The processor 162 may include a non-transitory processor-readable medium storing code representing instructions to cause the processor to perform a process. The processor 162 may be, for example, a commercially available microprocessor, an application-specific integrated circuit (ASIC) or a combination of ASICs, which are designed to achieve one or more specific functions, or enable one or more specific devices or applications. In certain embodiments, the controller 160 may be an analog or digital circuit, or a combination of multiple circuits. The controller 160 may also include one or more memory components 164 for storing data in a form retrievable by the controller. The controller 160 can store data in or retrieve data from the one or more memory components 164.

In various embodiments, the controller 160 may also comprise input/output (I/O) components to communicate with and/or control the various components of ice maker 103. In certain embodiments, for example, the controller 160 may receive inputs such as, for example, one or more indications, signals, messages, commands, data, and/or any other information, from the water level sensor 136, a harvest sensor 166 for determining when ice has been harvested, an electrical power source (not shown), an ice level sensor 141 for detecting the level of ice in the bin 104 (FIG. 1), and/or a variety of sensors and/or switches including, but not limited to, pressure transducers, temperature sensors, acoustic sensors, etc. In various embodiments, based on those inputs and predefined control instructions stored in the memory components 164, the controller 160 controls the ice maker 103 by outputting control signals to controllable output components such as the compressor 112, the condenser fan 115, the refrigerant expansion device 118, the hot gas valve 124, the water inlet valve 140, the drain valve 144, and/or the water pump 132. Such control signals may include one or more indications, signals, messages, commands, data, and/or any other information to such components.

The illustrated controller 160 is also operatively connected to a user interface device 165 comprising inputs (e.g., buttons, knobs, a capacitive touchscreen, or the like) through which a user can make commands to the controller and indicators (e.g., a display, a light panel, or the like) for providing indications of information related to the ice maker 103. Accordingly, the user interface device 165 provides an interface for local interaction with the ice maker 103. Although not shown, it is to be understood that the ice maker 103 can comprise a network interface device (e.g., a wireless transceiver, a wired Ethernet card, etc.) to provide a remote interface through which an operator can interact remotely with the ice maker.

Figure 16:
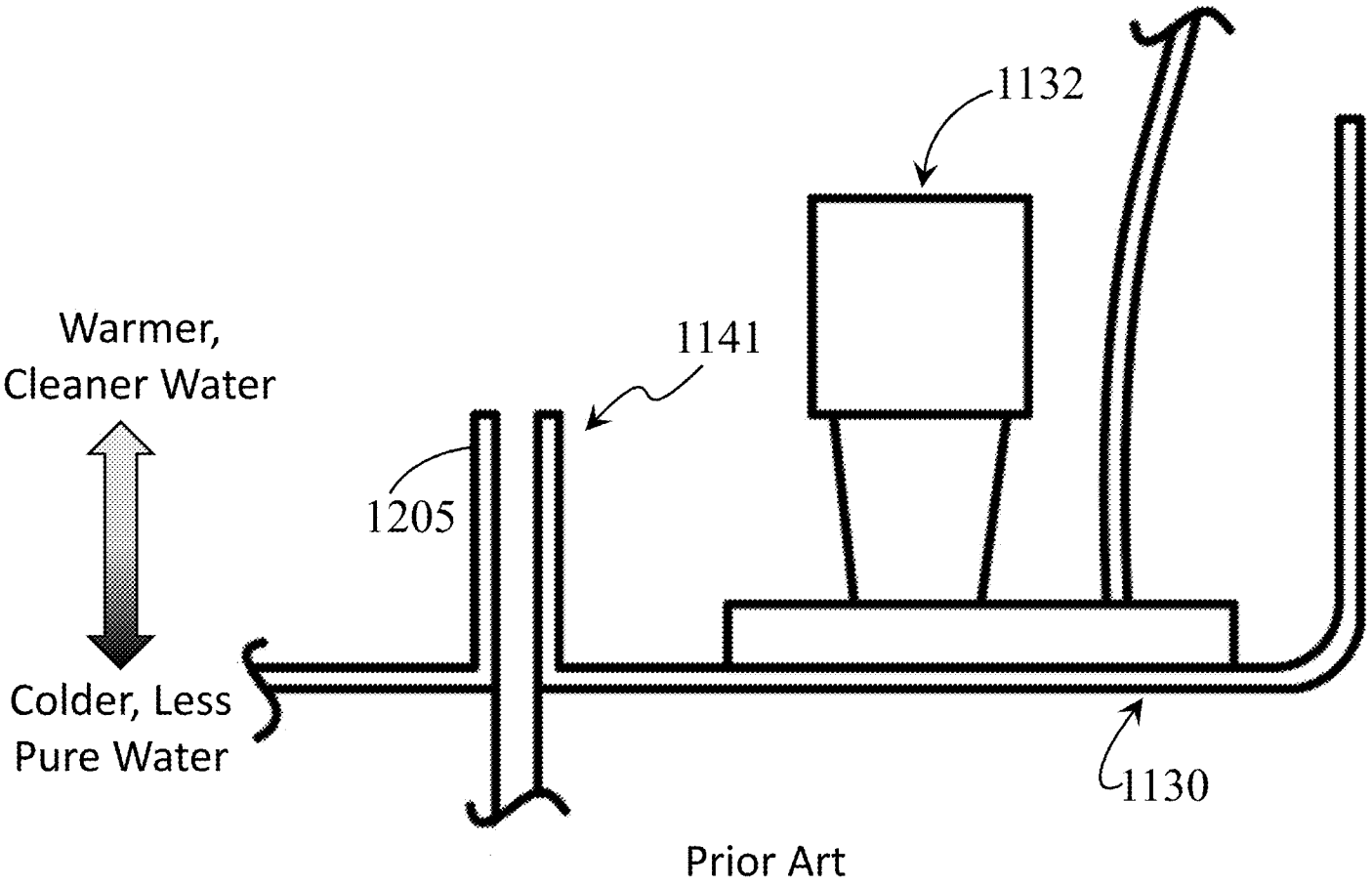
FIG. 16 is an enlarged schematic illustration similar to FIG. 3 but showing a prior art stand pipe drain.

The remainder of this disclosure focuses on exemplary features of the stand pipe drain 141 of ice maker. For purposes of comparison, FIG. 16 schematically illustrates an ice maker 1103 with a prior art stand pipe drain 1141. The prior art stand pipe drain 1141 comprises a stand pipe 1205 that extends upward from the bottom wall of the sump 1130. During use, anytime water in the sump 1130 rises above the top of the stand pipe 1205 the water above the stand pipe 1205 flows into the stand pipe drain 1141 through the open top end of the stand pipe 1205. The inventor recognizes that the water in sump has a temperature gradient along the height of the sump, with colder, less pure water toward the bottom and warmer, cleaner water toward the top. Thus, when water drains through the prior art stand pipe drain 1141, it tends to be clean, warm water tends that is discharged, causing impurities to settle and become progressively more concentrated in the colder water at the bottom of the sump over time. As a result, when water is drained from the stand pipe drain 1141, it is the cleaner, warmer water at the top of the sump that flows into the stand pipe 1205—not the impure water toward the bottom of the sump 1130. Furthermore, the water pump 1132 draws the cold, relatively impure water from the bottom of the sump so that the ice maker 1103 makes less pure ice.

Figure 3:
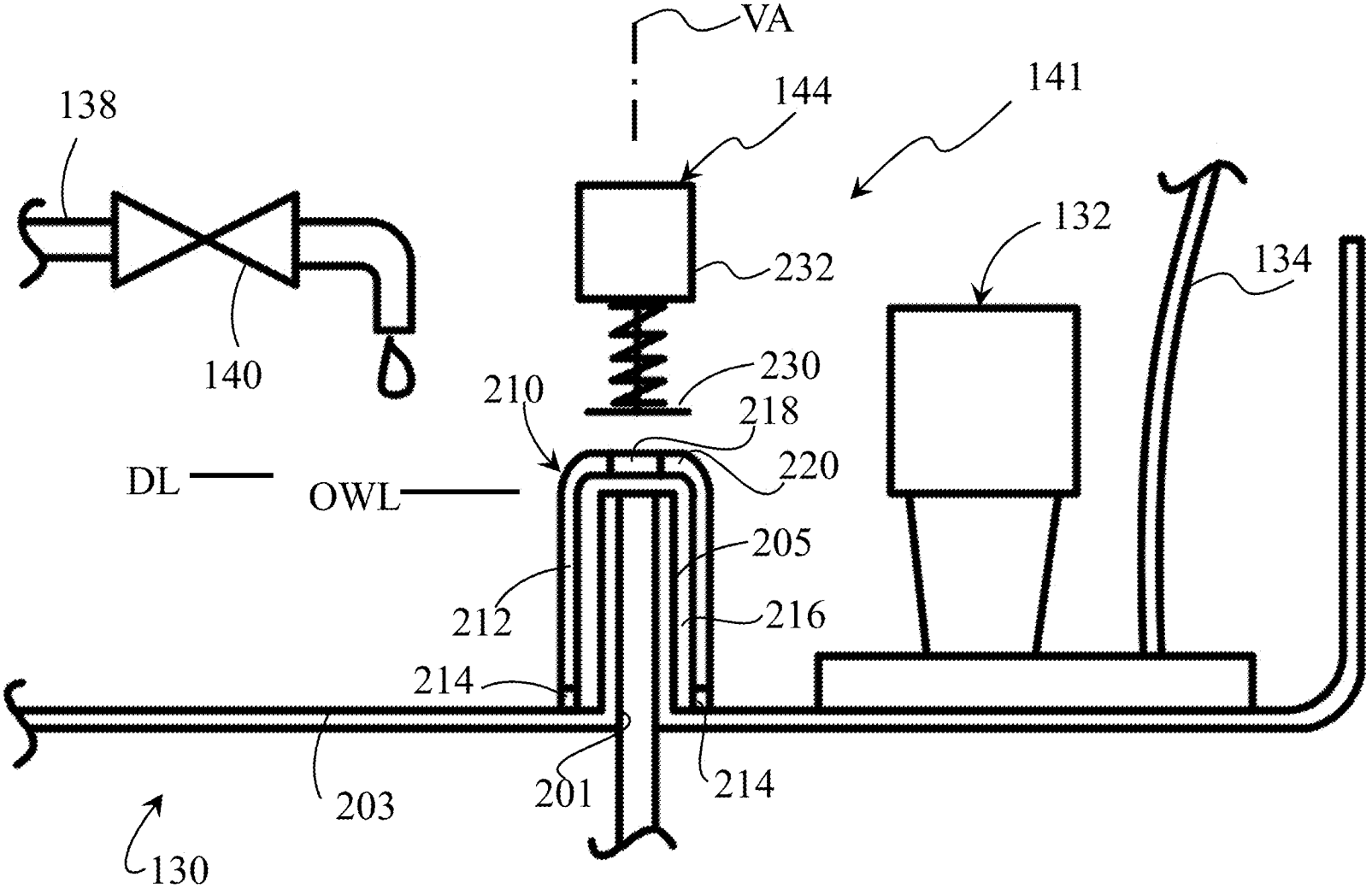
FIG. 3 is an enlarged schematic illustration of part of the ice maker, showing a stand pipe drain thereof in an overflow drain configuration.
Figure 4:
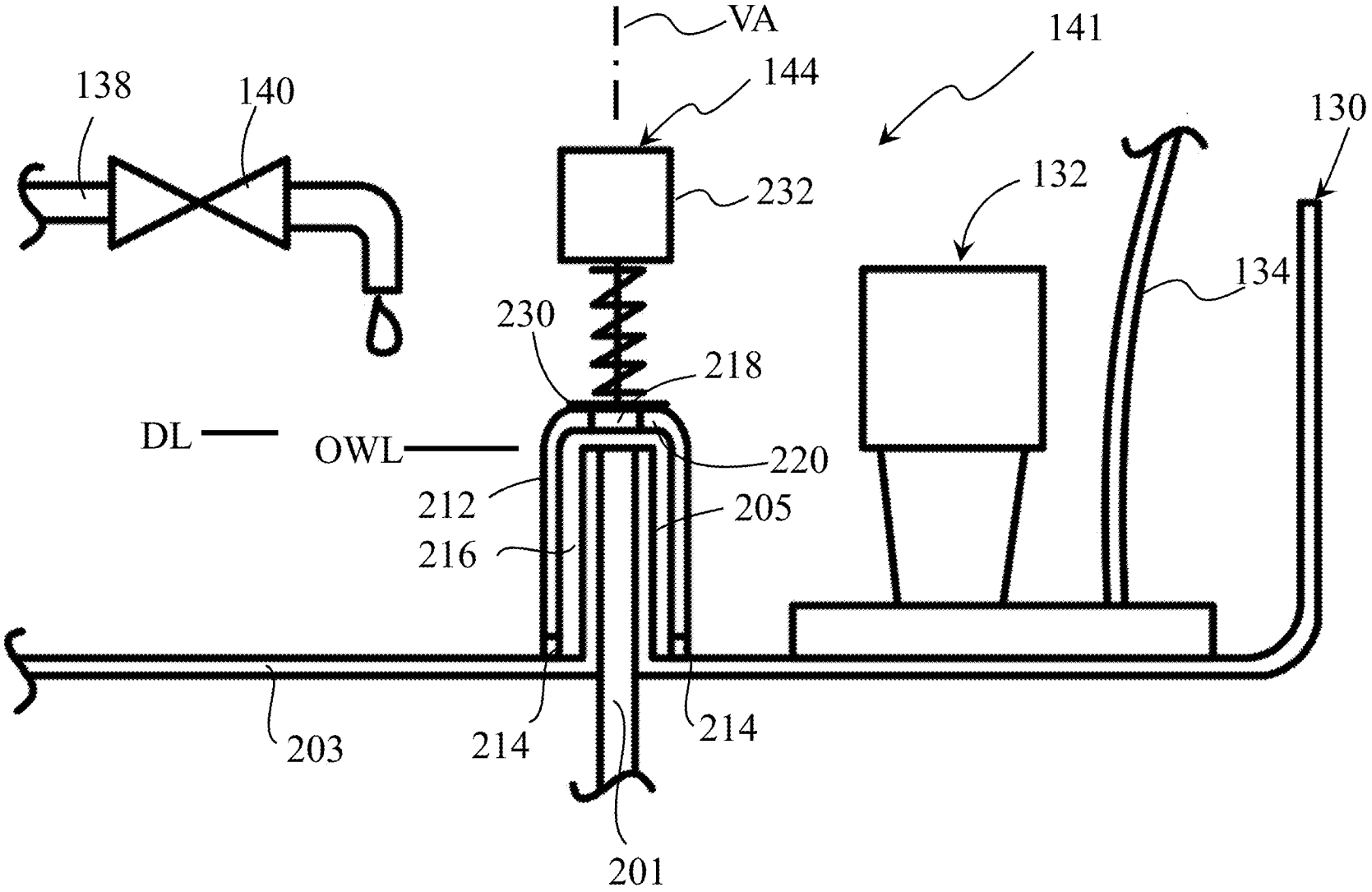
FIG. 4 is an enlarged schematic illustration similar to FIG. 3 but showing the stand pipe drain in a siphon drain configuration.
Figure 5:
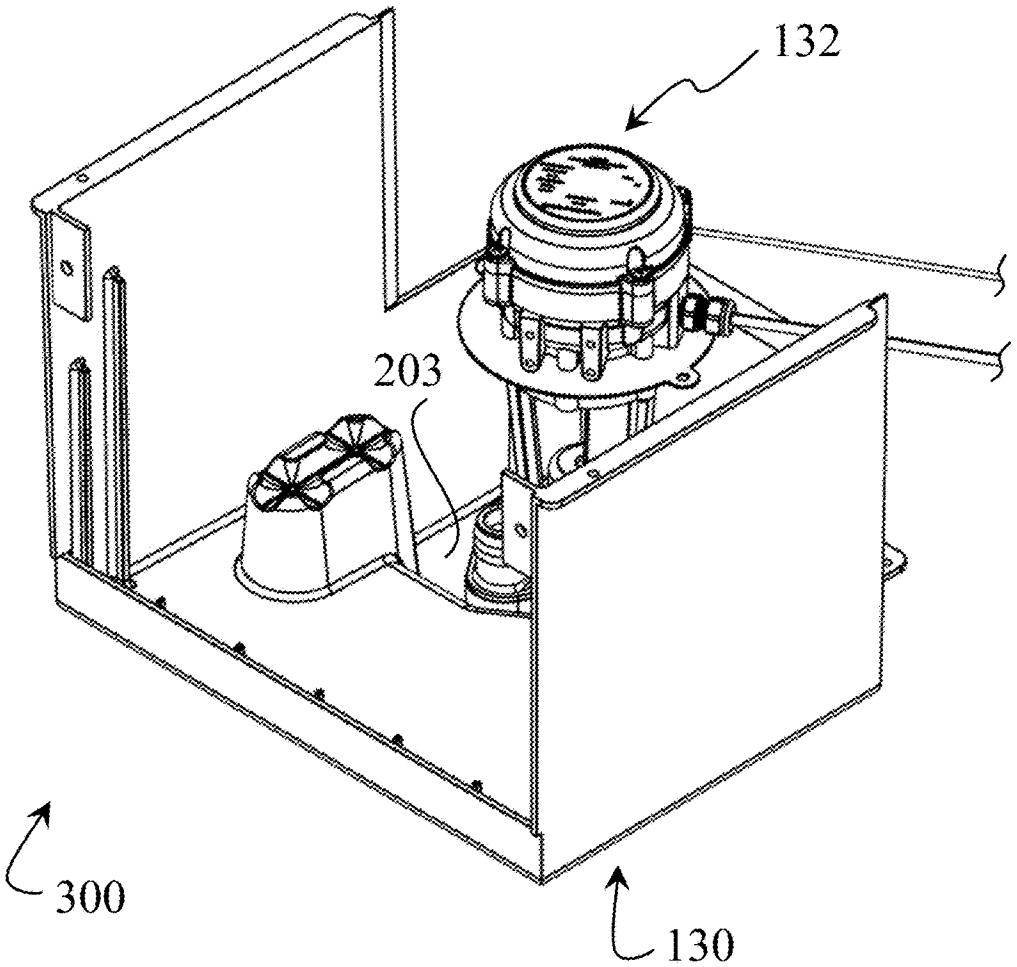
FIG. 5 is a perspective of a subassembly of the ice maker including a sump, a water pump, and a drain fitting of the stand pipe drain.
Figure 6:
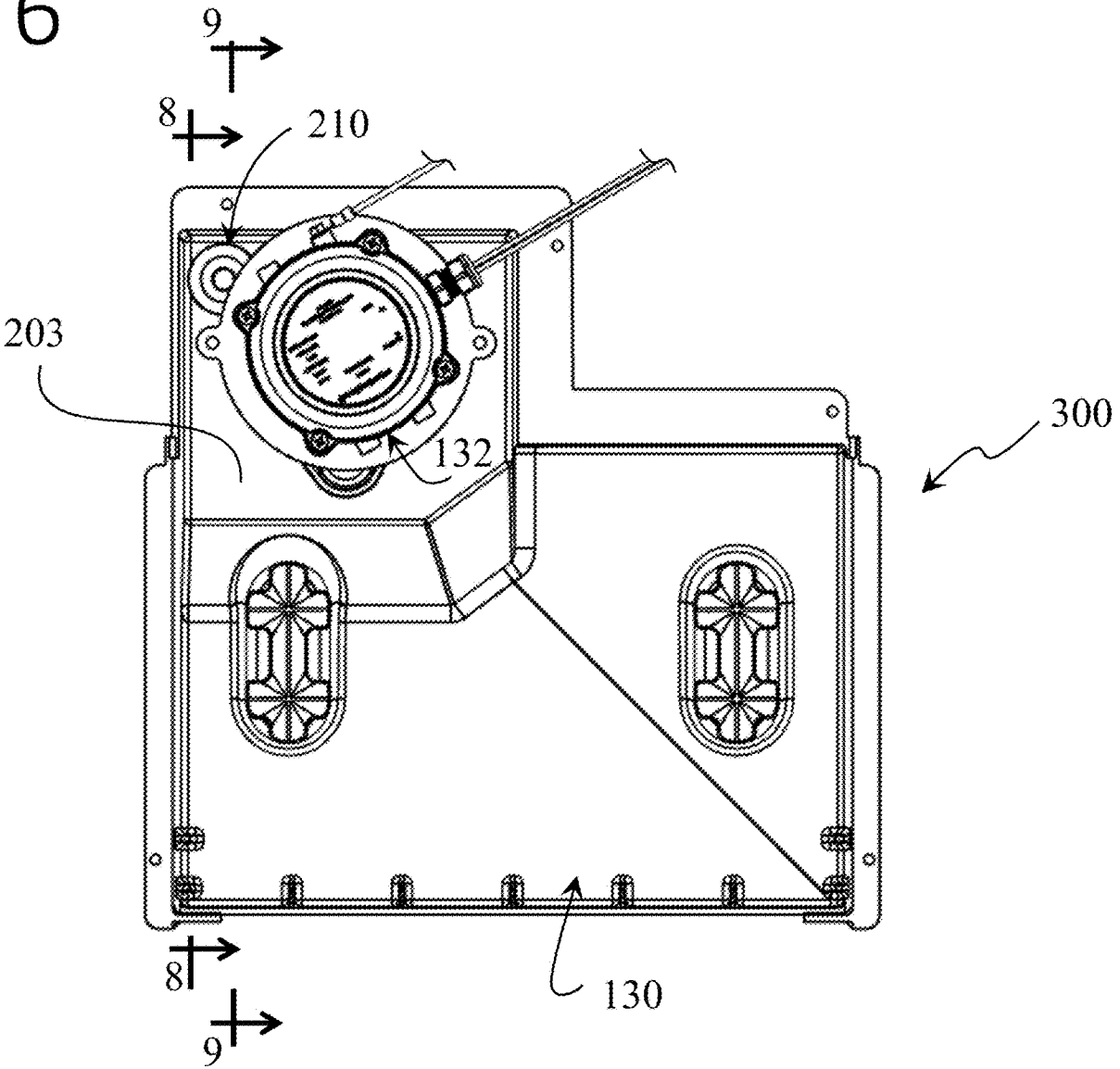
FIG. 6 is a top plan view of the subassembly of FIG. 5.

Referring now to FIGS. 3 and 4, in contrast to the stand pipe drain 1141 of the prior art, the stand pipe drain 141 of the present disclosure is configured to draw in water from the bottom of the sump 130. This enables the ice maker 103 of the present disclosure to drain the relatively impure water at the bottom of the sump while leaving the purer warmer water in the sump. Another optional feature of the of the stand pipe drain 141 of the present disclosure is that it is selectively adjustable between (i) an overflow drain configuration (FIG. 3) for draining water from the sump 130 to an overflow water level OWL and (ii) a siphon drain configuration (FIG. 4) for draining water from the sump to a water level less than the overflow water level. The stand pipe drain 141 is configured to drain water through an opening 201 in the bottom wall 203 of the sump 130.

The stand pipe drain 141 comprises a stand pipe 205 that extends upward from the bottom wall of the sump and a drain fitting 210 that fits over the stand pipe. The stand pipe 205 has a vertical center axis VA centered on the center of the drain opening 201. The stand pipe 205 has a lower end portion and an upper end portion spaced apart along the vertical axis VA. The lower end portion of the stand pipe 205 is sealingly engaged with the bottom wall 203 of the sump 130. For instance, in one or more embodiments, the stand pipe 205 and the bottom wall 203 of the sump 130 are integrally formed from a single piece of molded material so that there is a seamless connection of the stand pipe to the bottom wall. The stand pipe 205 has a pipe wall that extends 360° circumferentially about the drain opening 201. The upper end portion of the stand pipe 205 is open and defines the overflow water level OWL. When water in the sump 130 rises above the overflow water level OWL, it will flow into the open upper end portion of the stand pipe 205 and drain through the drain opening 201. As explained in further detail below, when the stand pipe drain 141 is in the overflow drain configuration (FIG. 3), water will drain to the overflow water level OWL and then stop draining. In the siphon drain configuration (FIG. 4), the stand pipe drain 141 forms a bell siphon so that essentially all of the water in the sump 130 can drain through the stand pipe 205.

The bell siphon draining process will now be briefly described. In the siphon drain configuration of FIG. 4, as water fills the sump 130, the top surface of the water is exposed to atmospheric pressure outside and inside the drain fitting 210. Outside the drain fitting 210, the water is exposed to atmosphere through the open top of sump 130. Inside the drain fitting 210, the top of the water is exposed to atmosphere through the empty stand pipe 205. As the water rises above the overflow water level OWL, it forms a seal above the stand pipe 205 inside the drain fitting 210, closing off the drain fitting's connection to atmospheric pressure. Then, as the water falls through the stand pipe 205, it creates a vacuum at the top of the drain fitting 210, drawing water from the sump 130 up the drain fitting and out through the stand pipe. The column of water in the stand pipe 205 and drain passage 142 continues to pull a vacuum at the top of the stand pipe. As long as the stand pipe drain 141 is maintained in the siphon drain configuration, it will continue to siphon water from the sump 130 until the water level falls below the inlet openings 214 of the fitting 210.

The drain fitting 210 has a lower end portion and an upper end portion spaced apart along the vertical axis VA. The drain fitting 210 has a perimeter wall 212 extending from the lower end portion to the upper end portion. The drain fitting 210 is disposed in relation to the stand pipe 205 such that the upper end portion of the drain fitting is above the open upper end portion of the stand pipe, the lower end portion of the drain fitting defines a water inlet 214 adjacent the bottom wall 203 of the sump 130, and the perimeter wall 212 extends 360° circumferentially about the stand pipe in relation to the vertical axis VA such that the stand pipe and the drain fitting define a drain passage 216 extending from the water inlet to the open upper end portion of the stand pipe. The upper end portion of the drain fitting 210 defines a siphon release opening 218 configured to provide fluid communication between the drain passage 216 and an area outside the drain fitting.

Referring to FIGS. 5-10, an exemplary embodiment of a subassembly for an ice maker that includes a sump 130, a stand pipe 205, and a drain fitting 210 is generally indicated at reference number 300. In these drawings, the drain valve 144 of the stand pipe drain 141 is omitted to show the features of and relationships between exemplary embodiments of the stand pipe 205, the drain fitting 210, and the sump 130 more clearly. As shown, in the illustrated embodiment, the stand pipe 205 is a substantially cylindrical pipe extending along the vertical axis VA from the bottom sump wall 203. The perimeter wall 212 of the drain fitting 210 is likewise cylindrical but has a larger diameter than the stand pipe 205. As a result, when the drain fitting 210 is secured to the stand pipe 205, the inner surface of the fitting perimeter wall 212 is spaced apart radially outward from the outer surface of the stand pipe 205 by one or more gaps, which define the drain passage 216.

Figure 7:
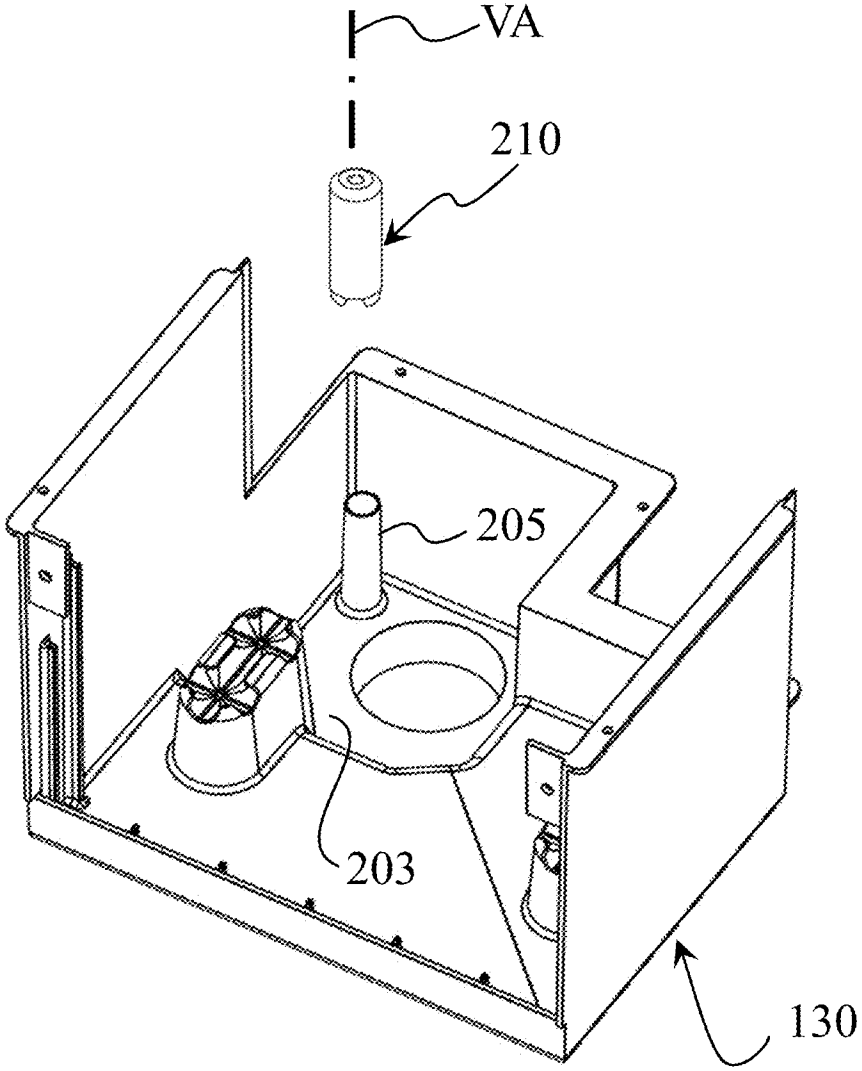
FIG. 7 is an exploded perspective of the sump and the drain fitting.
Figure 8:
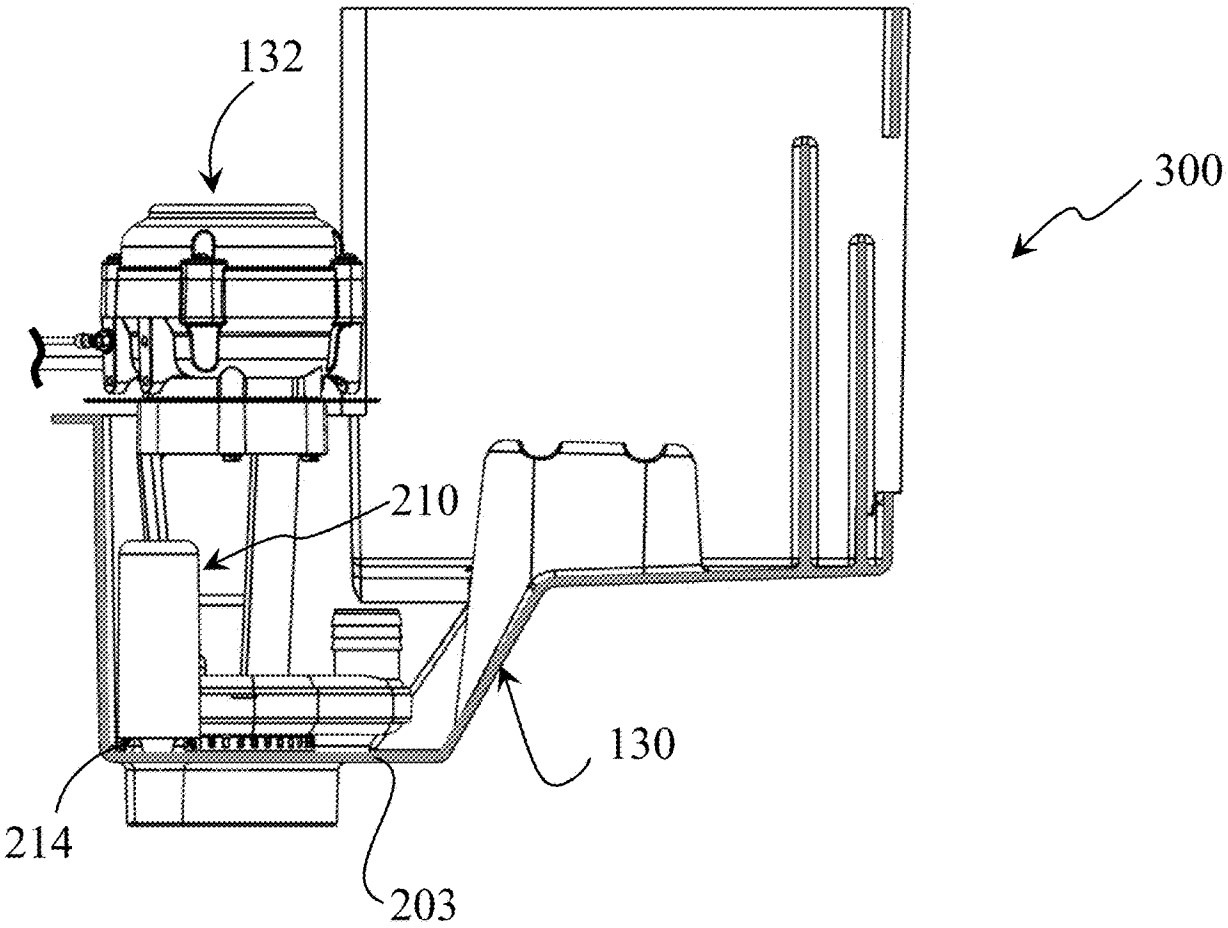
FIG. 8 is a cross section taken in the plane of line 8-8 of FIG. 6.
Figure 9:
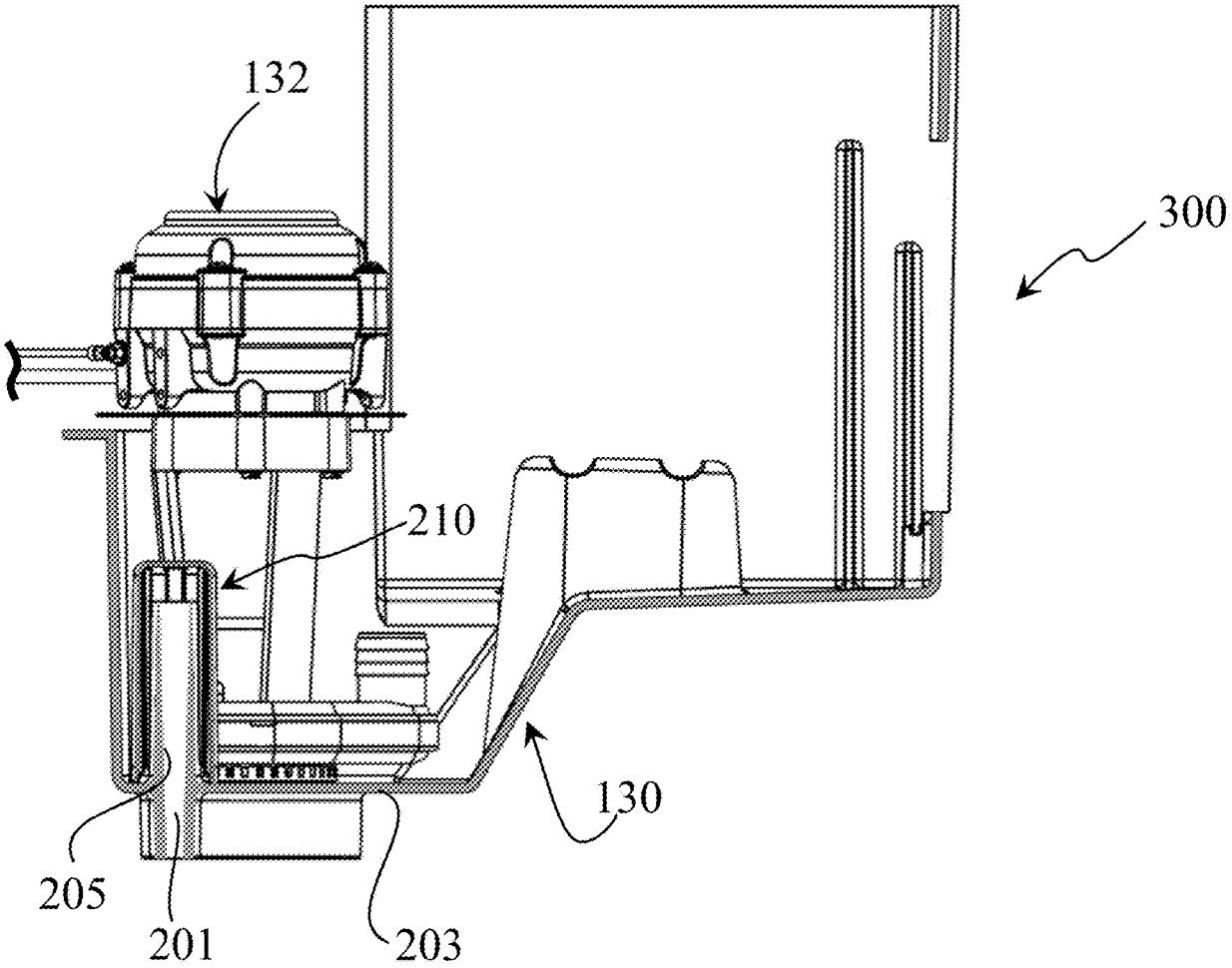
FIG. 9 is a cross section taken in the plane of line 9-9 of FIG. 6.
Figure 10:
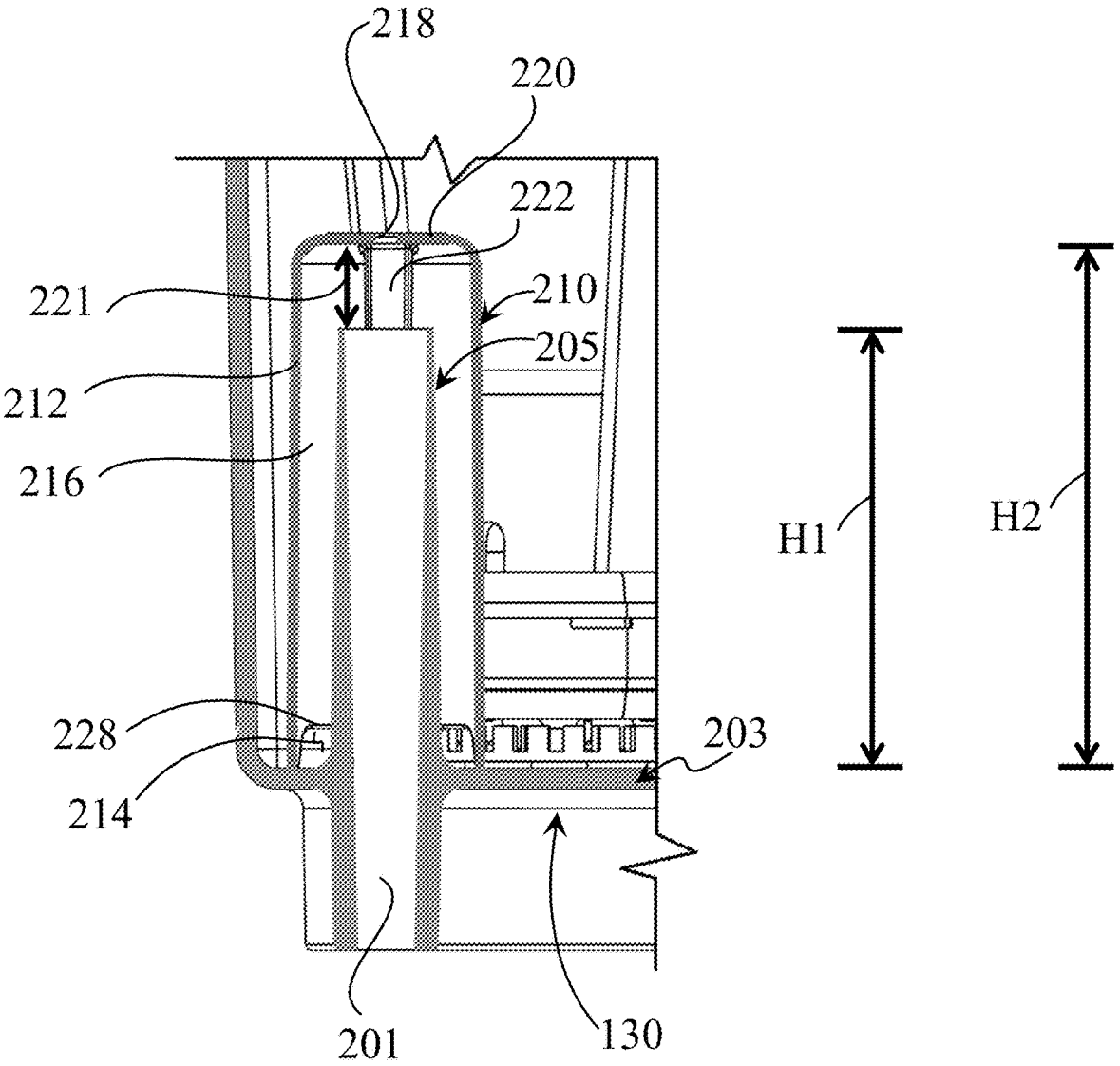
FIG. 10 is an enlarged view of a portion of FIG. 9.
Figure 11:
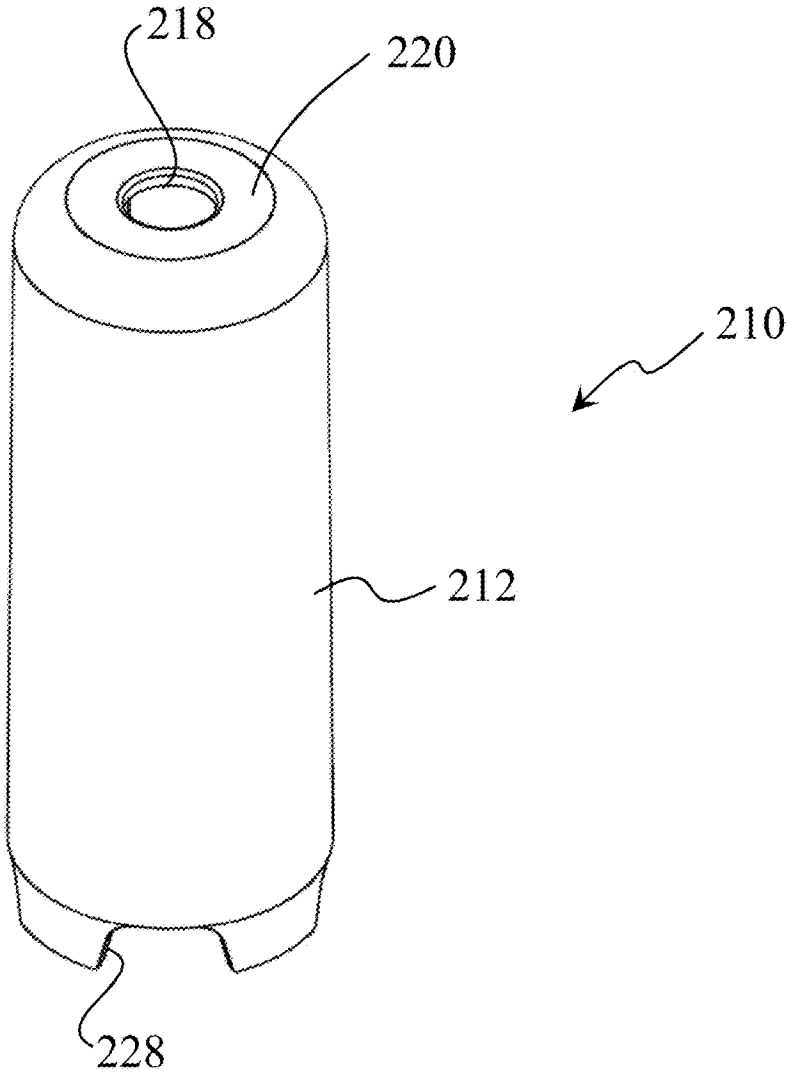
FIG. 11 is a perspective of the drain fitting.
Figure 12:
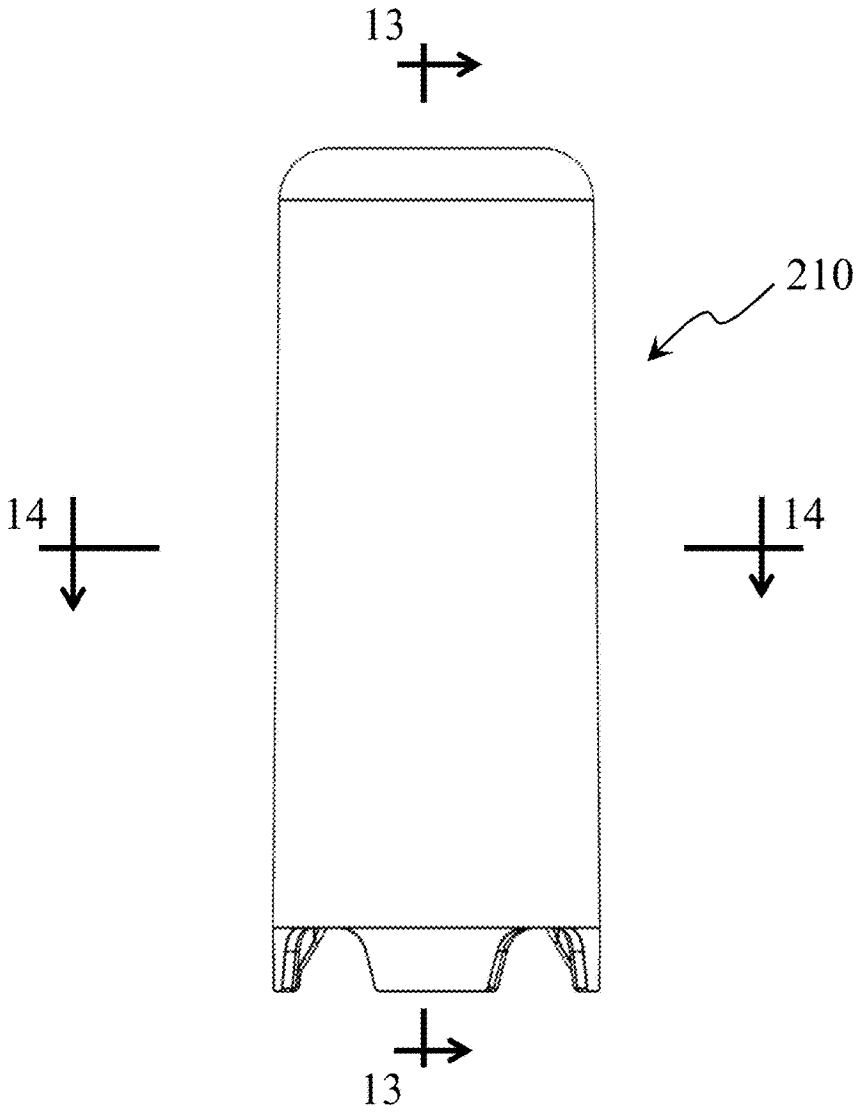
FIG. 12 is an elevation of the drain fitting.
Figure 13:
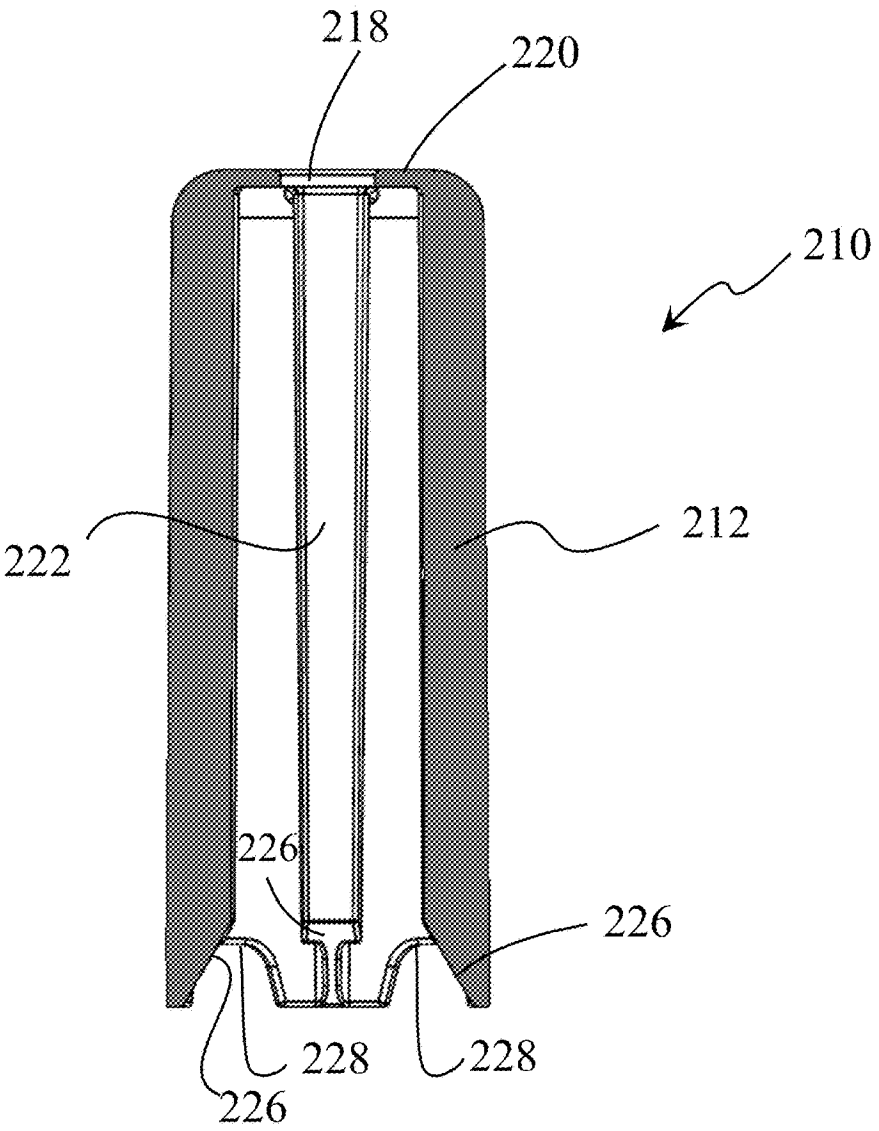
FIG. 13 is a cross-section taken in the plane of line 13-13 of FIG. 12.
Figure 14:
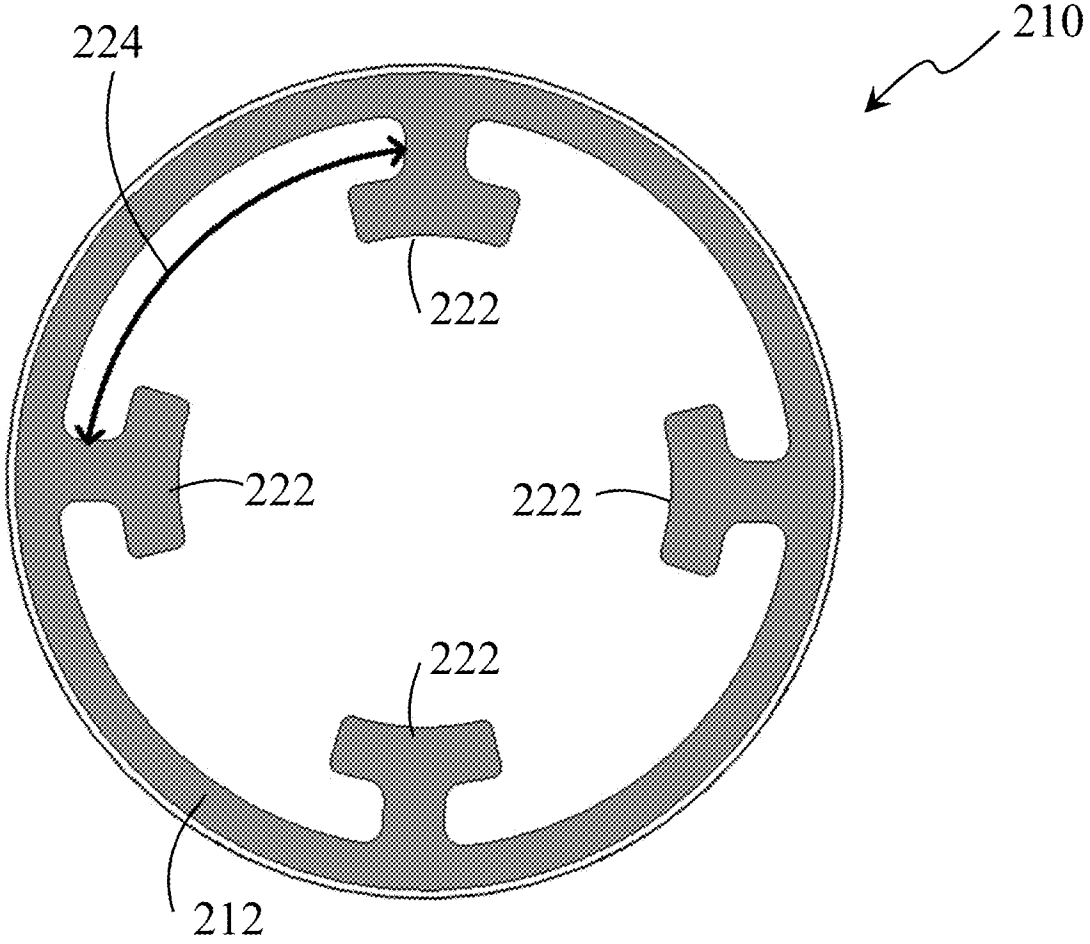
FIG. 14 is a cross section taken in the plane of line 14-14 of FIG. 12.
Figure 15:
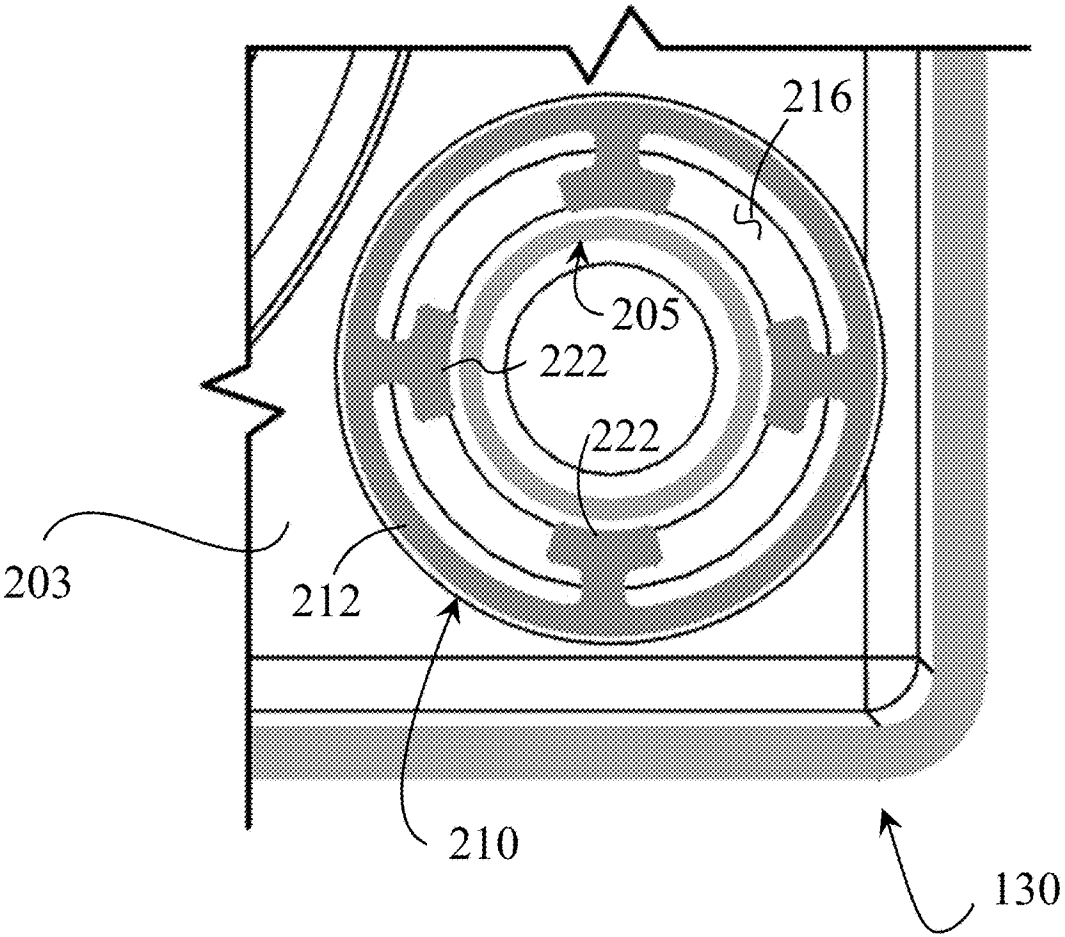
FIG. 15 is an enlarged fragmentary cross section of a portion of the subassembly of FIG. 5 at the same plane of the drain fitting as in FIG. 14.

The drain fitting 210 is configured to be pressed downward onto the stand pipe 205 (see FIG. 7). The lower end portion of the drain fitting 210 is open and the upper end portion of the drain fitting defines a lip 220 around the siphon release opening. 218 The stand pipe 205 has a height H1 (FIG. 10) extending from the bottom wall 203 to the open upper end portion along the vertical axis VA, and the lip 220 is spaced apart from the bottom edge of the fitting 210 by a height H2 (FIG. 2) that is greater than the height H1. Hence, when the drain fitting 210 is installed on the stand pipe 205, the bottom edge of the fitting 210 engages the bottom wall 203 of the sump 130 and there is a heightwise gap 221 between the upper end portion of the stand pipe and the lip 220. This heightwise gap 221 allows water above the overflow water level OWL to flow into the open upper end portion of the stand pipe 205. In addition, the heightwise gap 221 provides the necessary space to form a siphon vacuum chamber above the stand pipe 205 when the stand pipe drain 141 is operating in the siphon drain configuration.

Referring to FIGS. 10-15, the drain fitting 210 comprises a plurality of internal rails 222 circumferentially spaced apart about the perimeter wall 212. The internal rails 222 are configured to secure the drain fitting 210 on the stand pipe 205. In the illustrated embodiment, each of the internal rails has a T-shaped cross sectional shape (see FIG. 14). The outer section of the T-shaped rails 222 from the base of the 'T', and the inner section of the T-shaped rails 222 form the two outwardly extending arms at the top of the 'T'. The inner arm sections of the T-shaped rails have concavely curved inner surfaces to match the curved outer surface of the stand pipe 205. When the drain fitting 210 is pressed onto the stand pipe 205, the inner surfaces of the T-shaped rails 222 engage the outer surface of the stand pipe to support the drain fitting on the stand pipe. The circumferentially spaced internal rails 222 define circumferential gaps 224 between them. These gaps 224 define vertical portions of the drain passage that extend upward from the inlet 214 to the upper end portion of the stand pipe 205. Each internal rail 222 extends along the vertical axis VA from a lower end portion at the lower end portion of the drain fitting 210 to an upper end at the upper end portion of the drain fitting (e.g., to an upper end portion that meets the upper lip 220). In one or more embodiments, the lower end portion of each internal rail 222 includes a skewed end surface 226 angled to extend inward as it extends upward.

The lower end portion of the illustrated fitting 210 includes a plurality of circumferentially spaced apart inlet notches 228. The internal rails 222 are circumferentially interleaved between the inlet notches 228 such that there is one rail between each adjacent pair of inlet notches. The inlet notches 228 have open bottom ends. Between the notches 228, the lower end portion of the fitting 210 is configured to contact the bottom wall 203 of the sump 220 such that the inlet notches define the water inlet 214 (see FIG. 10). This configuration causes the stand pipe drain 141 to draw water into the drain from the bottom of the sump 130 where impurities tend to be concentrated. As a result of this configuration, the drain 141 can be used periodically to flush some of the water with relatively high concentrations of impurities from the sump 130 so that water with less impurities can be added to the sump and the ice produced by the ice maker maintains high clarity.

Referring again to FIGS. 3 and 4, the drain valve 144 is configured to selectively open and close the siphon release opening 218 at the upper end portion of the drain fitting 210. The drain valve 144 comprises a valve member 230 and a valve actuator 232 (e.g., an electric solenoid) configured to selectively move the valve member between an opened position (FIG. 3) and a closed position (FIG. 4). More particularly, the illustrated valve actuator 232 is configured to raise the valve member 230 to the opened position and lower the valve member to the closed position. The valve member 230 is configured to sealingly engage the upper end portion of the drain fitting 210 in the closed position to close the siphon release opening 218. Suitably, the valve member 230 makes an airtight seal with the upper end portion of the drain fitting 210 capable of holding a vacuum in the heightwise gap 221 (FIG. 10) between the upper end portion of the stand pipe 205 and the lip 220 of the drain fitting 210.

An exemplary method of using the ice maker 103 will now be briefly described. As explained above, the controller 160 is configured to direct the ice maker 103 to conduct ice making cycles in which the water system and refrigeration system work in concert to form ice I in the freeze plate 110 and then demold the ice to harvest it in the bin 104. In each ice making cycle, the controller 160 will open the water inlet valve 140 to fill the sump 130 to a defined starting level, then run the water pump 132 while using the refrigeration system to chill the freeze plate 110. During this stage, the sprayer 146 is spraying liquid water S into the molds 111. The freeze plate 110 chills the water so that some of the water freezes in the molds 111 and the remaining water falls back into the sump 130 at a reduced temperature. The vertical spraying continues until the controller 160 determines sufficient ice has formed in the molds 111. Then the controller 160 opens the hot gas valve 124 to heat the freeze plate 110 until the ice demolds and falls down the chute 147 into the ice bin 104. This cycle repeats for as long as there is demand for ice.

As ice making cycles are conducted, the controller 160 is configured to flush some or all of the water from the sump 130 through the stand pipe drain 141 to remove impurities. During normal use, the stand pipe drain 141 is in the overflow configuration shown of FIG. 3. Every n cycles (wherein $n \geq 1$), the controller 160 can conduct a partial flush. The controller 160 keeps the stand pipe drain 141 in the overflow drain configuration in FIG. 3. At the beginning of the ice making cycle, the controller opens the water inlet valve 140 to fill the sump 130 to a water level greater than the overflow water level OWL and keeps the water inlet valve 140 open for a period of time before closing the valve. This causes the stand pipe drain 141 to drain the amount of water added in excess of the overflow water level OWL. More particularly, the stand pipe drain 140 intakes water from the bottom of the sump 130 through the water inlets 214 and drains the water taken in through the stand pipe 205. As explained above, impurities tend to be concentrated in the water at the lower portion of the sump 130, so the partial flush beneficially flushes relatively impure lower sump water while maintaining a large amount of relatively pure chilled upper sump water in the sump for the next ice making cycle.

On some occasions, the controller 160 is configured to conduct a full drain. For example, in one or more embodiments, the controller 160 is configured to conduct a full drain every m cycles, wherein $m>n$. In some embodiments, the controller 160 is configured to conduct a full drain after receiving a signal from the ice level sensor 141 that the ice bin 104 is full of ice. For example, the controller 160 receives a signal that the ice bin 140 is full of ice, directs the refrigeration system and water system to stop making ice, and conducts a full drain operation as explained below.

During each full drain operation (also called a siphon drain cycle), the controller is configured to direct the drain valve 144 to close and seal the siphon release opening 218. The controller 144 also directs the water inlet valve 140 to fill the sump to a drain starting level DL greater than the overflow water level OWL. When the siphon release opening 218 is closed, as water above the overflow water level OWL begins to drain through the stand pipe 205, it creates a vacuum in the gap 221 (FIG. 10) between the upper end portion of the stand pipe and the now-closed upper end portion of the drain fitting 210. This vacuum will continue to draw water from the sump 130 through the inlets 214 into the stand pipe 205 until the vacuum is broken. The vacuum can be broken at any time by opening the drain valve 144 to reconfigure the drain 141 in the overflow drain configuration. But if the drain valve 144 is not opened, the vacuum in the upper end portion of the drain fitting 210 will draw water out of the sump 130 until the water level falls below the inlet 214—i.e., until the sump is essentially empty.

Accordingly, it can be seen that the inventor has provided an ice maker 103 with a stand pipe drain 141 that can be used selectively as an overflow drain (by keeping the siphon release opening 218 open) and a siphon drain (by closing the siphon release opening 218). The inventor believes that this multi-purpose stand pipe drain can provide enhanced drainage capabilities without substantially increasing the manufacturing complexity or cost over conventional single-purpose drain configurations. Moreover, the drain fitting 210 provides a simple solution for enabling partial flushing of the sump by drawing water from the bottom of the sump where there may be relatively high concentrations of impurities.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. An ice maker comprising:

an ice formation device;

a sump below the ice formation device, the sump having a bottom wall;

a pump for recirculating water from the sump to the ice formation device so that the water forms as ice on the ice formation device;

a stand pipe extending upward from the bottom wall of the sump and having an open upper end portion, the stand pipe configured so that water can flow into the stand pipe through the open upper end portion to drain from the sump;

a drain fitting having a lower end portion, an upper end portion opposite the lower end portion, and a perimeter wall extending from the lower end portion to the upper end portion, the drain fitting disposed in relation to the stand pipe such that the upper end portion of the drain fitting is disposed above the open upper end portion of the stand pipe, the lower end portion of the drain fitting defines a water inlet adjacent the bottom wall of the sump, and the perimeter wall extends 360° about the stand pipe such that the stand pipe and the drain fitting define a drain passage extending from the water inlet to the open upper end portion of the stand pipe, the upper end portion of the drain fitting defining a siphon release opening configured to provide fluid communication between the drain passage and an area outside the drain fitting; and a drain valve comprising a valve member and a valve actuator configured to selectively move the valve member between an opened position in which the valve member opens the siphon release opening so the siphon release opening provides, above the open upper end portion of the stand pipe, a connection between the drain passage and atmospheric pressure and a closed position in which the valve member sealingly engages the upper end portion of the drain fitting to close the siphon release opening and close off the connection between the drain passage and atmospheric pressure.

2. The ice maker as set forth in claim 1, wherein the valve actuator is configured to raise the valve member to the opened position and lower the valve member to the closed position.

3. The ice maker as set forth in claim 1, further comprising a water inlet valve and a controller configured to control the drain valve and the water inlet valve.

4. The ice maker as set forth in claim 3, wherein the controller is configured to execute a siphon drain cycle by controlling the drain valve to close the siphon release opening and controlling the water inlet valve to fill the sump to a siphon drain starting level above the open upper end portion of the stand pipe, whereby water in the sump is siphoned into the stand pipe through the drain passage.

5. The ice maker as set forth in claim 1, wherein the drain fitting comprises a plurality of internal rails circumferentially spaced apart about the perimeter wall.

6. The ice maker as set forth in claim 5, wherein the internal rails are configured to secure the drain fitting on the stand pipe.

7. The ice maker as set forth in claim 5, wherein each of the internal rails has a T-shaped cross sectional shape.

8. The ice maker as set forth in claim 5, wherein the internal rails define circumferential gaps between them, the circumferential gaps defining a portion of the drain passage.

9. The ice maker as set forth in claim 5, wherein each internal rail extends from a lower end portion at the lower end portion of the drain fitting to an upper end at the upper end portion of the drain fitting.

10. The ice maker as set forth in claim 9, wherein the lower end portion of each internal rail includes a skewed end surface angled to extend inward as the lower end portion of the internal rail extends upward.

11. The ice maker as set forth in claim 5, wherein the lower end portion of the drain fitting includes a plurality of circumferentially spaced apart inlet notches.

12. The ice maker as set forth in claim 11, wherein the internal rails are circumferentially interleaved between the inlet notches.

13. The ice maker as set forth in claim 1, wherein the lower end portion of the drain fitting includes a plurality of circumferentially spaced apart inlet notches.

14. The ice maker as set forth in claim 13, wherein the inlet notches have open bottom ends and wherein the lower end portion of the drain fitting is configured to contact the bottom wall of the sump between the inlet notches such that the inlet notches define the water inlet.

15. The ice maker as set forth in claim 1, further comprising a water inlet valve configured to selectively impart water into the sump.

16. The ice maker as set forth in claim 15, further comprising a controller configured to control the drain valve and the water inlet valve to selectively conduct partial flush cycles and full drain cycles.

17. The ice maker as set forth in claim 16, wherein during each partial flush cycle, the controller is configured to control the drain valve so the valve member is in the opened position, open the water inlet valve to fill the sump with water above the open upper end portion of the stand pipe so water from the bottom of the sump flows through the water inlet and the drain passage and overflows into the open upper end portion of the stand pipe, and then close the water inlet valve.

18. The ice maker as set forth in claim 17, wherein during each full drain cycle, the controller is configured to control the drain valve so the valve member is in the closed position, open the water inlet valve to fill the sump to a drain level above the open upper end portion of the stand pipe, and then close the water inlet valve so that the water from the sump is suctioned out of the ice maker through the water inlet and drain passage until the water level falls below the water inlet.

19. The ice maker as set forth in claim 18, wherein the controller is configured to control the ice maker to conduct ice batch production cycles, wherein the controller is configured to conduct partial flush cycles every nice batch production cycles and to conduct full drain cycles every m ice batch production cycles.

20. The ice maker as set forth in claim 19, wherein m>n.

* * * * *